United States Patent [19]

Fearon et al.

[11] Patent Number: 4,799,045

[45] Date of Patent: Jan. 17, 1989

[54] METHOD OF DETECTING A LABEL USED IN AN ANTI-THEFT SURVEILLANCE SYSTEM

[75] Inventors: Edward R. Fearon, Richardson, Tex.; Robert E. Fearon, Tulsa, Okla.

[73] Assignee: E.A.S. Technologies, Inc., Richardson, Tex.

[21] Appl. No.: 74,956

[22] Filed: Jul. 17, 1987

Related U.S. Application Data

[63] Continuation of Ser. No. 828,541, Feb. 12, 1986, Pat. No. 4,682,154.

[51] Int. Cl.[4] ..... G08B 13/18

[52] U.S. Cl. ..... 340/572; 340/551

[58] Field of Search ..... 340/572, 551

[56] References Cited

U.S. PATENT DOCUMENTS

| | | | |
|---|---|---|---|
| 3,631,442 | 12/1971 | Fearon | 340/572 |
| 3,754,226 | 8/1973 | Fearon | 340/572 |
| 3,790,945 | 2/1974 | Fearon | 340/572 |
| 3,820,103 | 6/1974 | Fearon | 340/572 |
| 3,820,104 | 6/1974 | Fearon | 340/572 |
| 4,158,434 | 6/1979 | Peterson | 340/572 |
| 4,222,517 | 9/1980 | Richardson | 340/572 |
| 4,298,862 | 11/1981 | Gregor et al. | 340/572 |
| 4,300,183 | 11/1981 | Richardson | 340/572 |
| 4,308,530 | 12/1981 | Kip et al. | 340/551 |
| 4,413,254 | 11/1983 | Pinneo et al. | 340/572 |
| 4,484,184 | 11/1984 | Gregor et al. | 340/572 |
| 4,527,152 | 7/1985 | Scarr et al. | 340/572 |
| 4,539,558 | 9/1985 | Fearon | 340/572 |
| 4,568,921 | 2/1986 | Pokalsky | 340/572 |
| 4,646,090 | 2/1987 | Mawhinney | 340/572 |

*Primary Examiner*—Glen R. Swann, III

*Attorney, Agent, or Firm*—Jerry W. Mills

[57] ABSTRACT

Permanently magnetized members (24, 26) of a surveillance system label (16) are disposed adjacent a ferromagnetic nonlinear element (30) for biasing the hysteresis loop of the nonlinear element (30) near the knee (40) of the magnetization curve. The nonlinear element (30) includes low permeability sections (32,34) and a high permeability section (36). The high permeability section (36) of the nonlinear element (30) is disposed adjacent a radiating dipole (28) for radiating the summation frequency of a pair of frequencies impinging on the nonlinear element (30). A memory magnet (38) with a changeable magnetism is disposed adjacent the high reluctance section (36) of the nonlinear element (30). The magnetism of the memory magnet (38) can be changed to provide either an active or inactive status of the label (16).

4 Claims, 1 Drawing Sheet

METHOD OF DETECTING A LABEL USED IN AN ANTI-THEFT SURVEILLANCE SYSTEM

RELATED APPLICATIONS

This is a continuation application of application Ser. No. 828,541, filed Feb. 12, 1986 and entitled "Label For Use in Anti-Theft Surveillance System", now U.S. Pat. No. 4,682,154, issued July 21, 1987.

TECHNICAL FIELD OF THE INVENTION

The present invention relates in general to anti-theft surveillance systems, and more particularly to the construction of a laminated ferromagnetic label responsive to superhigh frequencies.

BACKGROUND OF THE INVENTION

Anti-theft and anti-pilferage surveillance systems have been extensively used to reduce the loss of unpaid goods in the retail merchandising industry. Such detection systems generally comprise two major components. First, a specially constructed label or tag is affixed to the goods and is activated to respond to electromagnetic energy for providing an indication of the label or tag, and thus the article of merchandise itself. Secondly, the detection system includes a source of electromagnetic energy, generally in the Very High Frequency (VHF) range, which is transmitted in the zone of detection. The detection system also includes a receiver for detecting changes in the transmitted energy due to a label passing through the detection zone. In this manner, articles which have not been paid for, and thus which still include a label, can be detected before a shoplifter exits the premises. Of course, when a sale of the article has been properly made, the label is either removed or deactivated, thereby preventing an alarm by the detection system.

In the anti-theft surveillance systems documented in the art, the mechanism generally employed for detecting the presence of the label or tag is the occurrence of a high frequency generated by label, which frequency is harmonically related to the frequencies transmitted within the zone of detection. For example, in U.S. Pat. No. 4,298,862, by Gregor et al., the label is constructed of a strip of amorphous ferromagnetic metal which produces magnetic fields at frequencies which are harmonics of the fundamental 8 KHz frequency generated by a transmitter within the zone of detection.

U.S. Pat. No. 4,527,152 by Scharr et al. discloses an anti-shoplifting system comprising a pair of electromagnetic coils located on each side of the zone of surveillance, and a special label with magnetic properties which is detectable in such zone. The coils are alternately driven in and out of phase with a fundamental frequency of 12.5 KHz to produce a magnetic field characterized by three vectors. The magnetic label includes a permeability of 100,000, and a coercive force of 0.05 Oersteds. The magnetic label produces a signal of approximately the 160th harmonic of the fundamental frequency. As the label passes through the zone of surveillance, a detector detects the harmonic signal and provides an alarm to signal that unauthorized merchandise associated with the label is passing through the zone.

The labels heretofore utilized with theft detection systems have required a high level of energy to satisfactorily operate in conjunction with the magnetic properties of the label. Because of the construction of the labels, a high level of magnetic energy was required to sufficiently saturate the ferromagnetic label material so that harmonic frequencies could be produced. As noted in the prior art patents, the energy transmitted by the detection systems occurred in the VHF band. The construction of labels or tags responsive to these frequencies and energy levels necessitated a substantial amount of ferromagnetic material in the tag. As a result, the labels tend to be large and difficult to attach to merchandise, as well as being lossy and inefficient in operation.

Further, previously developed detection systems have been limited to the VHF range, although higher level frequencies would provide advantages in detection. Such prior systems were so limited because higher frequencies would require higher energy levels, which would create practical manufacturing and operating problems, as well as possible health problems.

From the foregoing, it may be seen that a need has arisen for an improved anti-theft surveillance system which operates in the superhigh frequency range, and a label or tag which is smaller in size, less cumbersome and more easily manufactured.

SUMMARY OF THE INVENTION

An improved anti-theft surveillance system and associated label is disclosed which eliminates or substantially reduces the problems noted with the prior art systems. In accordance with the principles and concepts of the present invention, a relatively small label can be produced which is responsive to electromagnetic radiation in the gigahertz frequency range.

In accordance with one embodiment of the invention, a high frequency responsive label includes a member including several very thin layers of a ferromagnetic material, such as iron, separated by an insulating layer, such as a gadolinium or holmium oxide. The layers of ferromagnetic material are formed by chemical deposition or sputtering to provide micro-thin metallic layers. Preferably, the layers are sufficiently thin such that the ferromagnetic properties of the material are lost. The composite layers of ferromagnetic and insulating materials provide a label with a substantial decrease in eddy current losses, and a high degree of sensitivity to frequencies in the superhigh frequency range.

The layered or laminated member is embodied in a label having a permanently magnetized member having a very high coercivity. The magnetized member is fixed close to the layered member for biasing the latter near the knee of its hysteresis curve. The laminated element includes a section of high permeability material intermediate a pair of sections of low permeability material. The low permeability sections comprise the sandwiched ferromagnetic material, and the high permeability section is a necked down section so that magnetic flux becomes concentrated in such section. With the high and low reluctance sections, the laminated element is nonlinear, and thus produces a sum and difference frequency in response to a pair of superhigh frequencies.

A radiating dipole is located adjacent the high permeability section for radiating a sum and difference frequency. A receiver/alarm detects the summation frequency and warns security personnel of the presence of the label within the zone of surveillance.

A memory magnet is disposed adjacent the laminated nonlinear element for providing an active and nonactive state to the label. When the memory magnet has been degaussed, its magnetic field is weak and the high permeability section of the nonlinear element is not saturated, and thus it is capable of responding to transmitter frequencies by producing a summation frequency. When the memory magnet is placed in its fully magnetized state, the high permeability section of the nonlinear element becomes saturated and in nonresponsive to the transmitter frequencies.

In another embodiment of the invention the nonlinear laminated element is constructed by intermingling ferromagnetic and paramagnetic materials to form an amorphous composition which has excellent high frequency characteristics.

BRIEF DESCRIPTION OF THE DRAWINGS

Further features and advantages of the present invention will become apparent from the description of an illustrative embodiment thereof, taken in conjunction with the accompanying drawings, in which.

DETAILED DESCRIPTION OF THE INVENTION

Figure 1:
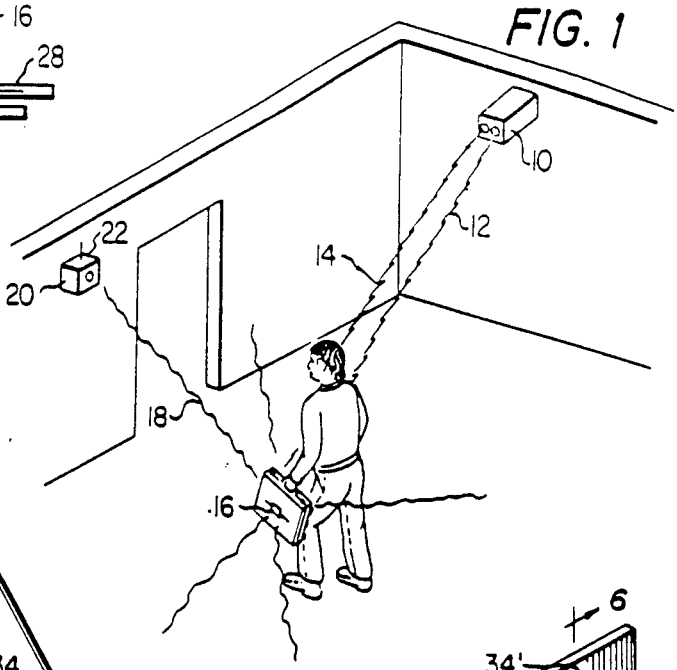
FIG. 1 illustrates the anti-theft surveillance system according to the invention.

The application of the invention is best understood by referring first to FIG. 1 of the drawings. Shown in FIG. 1 is an anti-theft surveillance system including a transmitter 10 for transmitting dual electromagnetic frequencies 12 and 14, a passive label 16 responsive to the frequencies of the transmitter 10 for generating yet other radiation energy 18. Provided also is a receiver/alarm 20 which is sensitive to the electromagnetic waves 18 for sounding an alarm 22.

More particularly, the transmitter 10 of the invention emits plural electromagnetic frequencies in the superhigh frequency range (3 to 30 gigahertz). In the preferred embodiment of the invention, the transmitter frequencies are envisioned to fall in the range of 1–10 gigahertz. Transmitters operable to transmit energy at these frequencies and of a few milliwatts power are readily available in the art, and will thus not be further discussed here. The label 16 comprises a composite magnetic element with nonlinear characteristics such that the radiation 18 emitted therefrom includes the sum and difference frequencies of the transmitter radiation 12 and 14. The receiver/alarm 20 is of conventional design and is of the narrow band type which is responsive to the summation of transmitter frequencies 12 and 14. As a result, the receiver 20 is responsive to electromagnetic radiation in the low gigahertz frequency range. The alarm 22 may be of the visual or audio type which is capable of alerting security personnel that an activated label 16, which is normally attached to unpaid merchandise, is being removed from the premises. The prevention of such unauthorized removal of merchandise can significantly reduce business costs, and provide a deterrent of the theft of goods by shoplifters or thieves.

The foregoing illustrates the basic components of the anti-theft security system according to the invention. It will be understood by those skilled in the art that such components are shown only for purposes of illustrating the principles and concepts of the invention. The functions of the system may be accomplished in a variety of other forms. It is noteworthy to appreciate that with the use of the present invention, no large and bulky portal apparatus, through which a person must pass, is necessary. The invention therefore greatly simplifies the apparatus of the theft surveillance system, in addition to providing a more inconspicuous method of surveillance.

Figure 2:
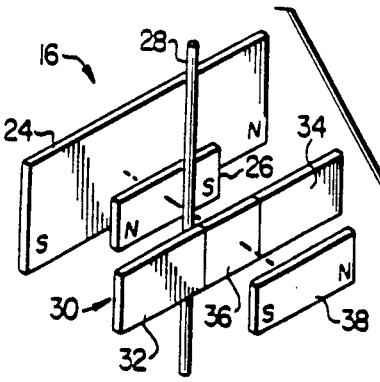
FIG. 2 is an isometric view of an anti-theft label constructed in accordance with the present invention, shown with the components thereof in exploded form.

Turning now to FIG. 2 of the drawings, there is shown a label 16 constructed in accordance with one embodiment of the invention. Generally, the label 16 includes a pair of permanently magnetized elements 24 and 26, element 26 being somewhat smaller in size than that of element 24 for the reasons described below. An electromagnetic radiating dipole 28, comprising a length of wire, is oriented orthogonal to the permanent magnetic elements 24 and 26. Adjacent the radiating dipole 28 is a nonlinear element 30 comprising a pair of magnetically soft members 32 and 34, characterized as material having a relatively low permeability for magnetic flux. Attaching members 32 and 34 is a connecting member 36 having a high permeability to magnetic flux. The label 16 further includes a permanent memory magnetic element 38 for placing the label 16 in either an active or nonactive state.

The permanently magnetized member 24 is constructed of a ferromagnetic material having a coercive force generally in the range of 5,000–8,000 Oersteds. Permanently magnetized member 24 is about one inch long and one-half inch wide. It can be appreciated that with a label of this size, it can be conveniently attached to small articles not heretofore possible. Permanently magnetized member 26 is about half the size of that of member 24, and is constructed of a ferromagnetic material having identical electrical properties as that of member 24. The magnetic members 24 and 26 are poled as shown in FIG. 2. As noted, magnetic member 26 produces a magnetic field which opposes that of magnetic member 24. The use of the shorter magnetic member 26 in combination with longer magnetic member 24 produces a region along the horizontal median which is more uniform than that which would be achieved if only magnetic element 24 were employed. As will be discussed in more detail below, the high coercive forces of permanently magnetized members 24 and 26 provide a magnetic field for appropriately biasing the hysteresis characteristics of the nonlinear element 30.

In order to extend the operability of the label 16 into the low gigahertz frequency range, various considerations must be appreciated. First, while it is well known that the element iron is an excellent ferromagnetic material in the VHF band, the response is not expected to be as good in the gigahertz, or superhigh frequency band. In addition, low energy levels of transmitted radiation are desirable, both from a standpoint of safety, and also to maintain the magnetic elements of the label from becoming supersaturated with flux. Also, the earth's magnetic field, which is about 0.6 Oersteds, must be considered as having an influence on the magnetic properties of the label 16.

Contrary to the construction of prior surveillance systems, the present invention does not depend on the magnetic field of the earth to attain a reliable surveillance within a particular zone. This is highly important, as the metallic structural variations of buildings greatly alter the direction and strength of the earth's magnetic field. In this regard, the permanently magnetized members 24 and 26 present a magnetic field to the low permeability elements 32 and 34, which field is substantially higher than the magnetic field of the earth, but which will not saturate the magnetic properties of the low permeability elements 32 and 34. The magnetic field is provided also to appropriately bias the nonlinear ferromagnetic element 30 of the label 16 so that summation frequencies can be efficiently generated. This is accomplished by providing a constant magnetic field within the label by a material which has a coercive force much higher than that of, for example, Vicaloy or Cunife metal. There are several ways of providing a permanently magnetized members 24 and 26 with the requisite coercive forces.

Permanently magnetized members 24 and 26 can be constructed so as to achieve exceedingly high coercive forces by using material, identified as Silmanal, pulverized into sub-micron particle sizes. Particles in the ranges of about 0.01 microns can provide a powder which has a composite coercive force dependent upon the particle size. With sufficiently small particle sizes, there is no difficulty in achieving high coercive forces on the order of a magnitude greater than that of the Vicaloy material. Alternatively, a finely powdered cobalt samarium permanent magnetic alloy may be used to form the highly coercive permanent magnetized members 24 and 26. In addition, ferrospinels or soft iron may be employed in powder form to provide the necessary high coercive force ferromagnetic materials. Materials made in accordance with the foregoing may exhibit coercive forces on the order of 5,000–8,000 Oersteds. The magnetic influence of the permanently magnetized members 24 and 26 subject the low permeability elements 32 and 34 to the proper magnetic field irrespective of either the earth's magnetic field, or the structural environment in which the label 16 is disposed. As noted above, no special magnets or electromagnets are required in the portal equipment.

The radiating dipole 28 comprises a length of copper wire for radiating the summation frequency generated by the label 16. While the difference frequency is also radiated, it is not used by the receiver/alarm 20. For two distinct electromagnet radiations 12 and 14 in the 3 gigahertz range, the summation frequency generated by the low permeability elements 32 and 34 will be in the 6 gigahertz range. Such a summation frequency corresponds to a wavelength of about five centimeters. Thus, in order for the radiating dipole 28 to operate as a half wave dipole radiator, the length thereof should be about one inch. As a result, it can be appreciated that the label 16 has been miniaturized with regard to labels or tags heretofore known.

While the preferred embodiment of the invention will be described with regard to summation techniques, it will be understood that the present invention also encompasses the use of difference frequency techniques. For example, the present label could be used in a system which detects the sum of $f_1+f_2+f_0$, where $f_0$ is the steady state field supplied by the permanent magnet material of the label.

Disposed adjacent the radiating dipole 28, but in a noncontacting manner, is the nonlinear element 30. As noted above, low permeability elements 32 and 34 are hard members having a low permeability. These members 32 and 34 may be constructed in a sandwiched nature, consisting of a plurality of laminations of ultra-thin soft ferromagnetic material. Each such lamination of ferromagnetic material is isolated with an insulating material disposed therebetween. The particular construction of the nonlinear element 30 will be discussed in greater detail below. Bridging the low permeability members 32 and 34 is a high permeability area 36, which is disposed adjacent the radiating dipole 28. With the provision of the high permeability element 36 bridging the low permeability elements 32 and 34, the magnetic flux required to saturate the low reluctance members 32 and 34 is extremely large, compared with the number of magnetic flux lines required to totally saturate the high permeability bridging section 36.

Because of the high permeability of bridging section 36, and the resulting high concentration of magnetic flux therethrough, a nonlinear characteristic of the element 30 is created. The nonlinear performance of the ferromagnetic material of the high permeability bridging section 36 causes a magnetic current passing therethrough to have the ability to strongly excite the electrically conducting radiating dipole 28. For this reason, the radiating dipole extends perpendicularly to the direction of magnetic flux concentrated at the high permeability bridging section 36. The nonlinear characteristics of the element 30 cause the radiating dipole 28 to radiate energy corresponding to the summation and the difference of the interrogating frequencies 12 and 14 transmitted by transmitter 10.

Since it is well known that the radiation of an antenna, or similar device, improves as the frequency increases, it is preferable that the summation frequency of the transmitted electromagnetic waves 12 and 14 be the subject of receipt by receiver/alarm 20. Therefore, the two electromagnetic waves 12 and 14 impinging on the label 16 from the transmitter 10 generate a third frequency, comprising the sum of electromagnetic waves 12 and 14, which third frequency is transmitted omnidirectionally from the dipole 28, and is received by the receiver 20. In this manner, the label 16 emits a signal indicating its presence. Importantly, other metallic objects in the area of surveillance cannot generate the third summation frequency, and thus the reliability of the system is not compromised by the presence of metallic objects. The detection of the third frequency, i.e., the summation frequency, is therefore a clear indication of the presence of the label 16, and also of the unauthorized removal of merchandise on which the label 16 has not been deactivated.

Figure 3:
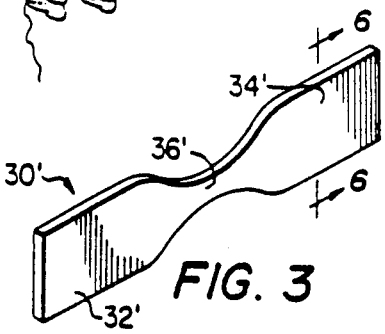
FIG. 3 is another embodiment of the nonlinear element with a midsection thereof necked down to form a high reluctance part.

With brief reference to FIG. 3, there is shown an alternative embodiment of the nonlinear element, denoted 30'. In this embodiment, the nonlinear element 30' is constructed of a low permeability material coextensive throughout the element, but including a "necked down" intermediate section 36' for producing an area having a higher reluctance than that of end sections 32' and 34'. The concentration of magnetic flux in the necked down portion 36' provides a magnetic coupling of the summation frequency to the radiating dipole, much like that of the nonlinear element 30 described above. Those skilled in the art may devise yet other types of nonlinear elements suitable for use with the present invention.

The permanent memory magnet 38 is constructed of a ferromagnetic substance which exhibits a coercive force in the range of 250–1,000 Oersteds. Moreover, the permanent memory magnet 38 is of the type which can take on different magnetization forces so as to render the entire label 16 either responsive or nonresponsive to the frequencies transmitted by transmitter 10. The label 16 can be switched to its active or responsive state by passing it through a degausser, or other similar field. When the label 16 is active, and thus is responsive to signals transmitted by transmitter 10, the permanent memory magnet 38 is not fully magnetized, and thus its magnetic influence on the nonlinear element 30 is minimized. The magnetic field induced into the nonlinear element 30 by the frequencies 12 and 14 of the transmitter 10 can then effect a coupling of the summation frequency to the radiating dipole 28, thereby triggering the receiver 20 to signal the unauthorized removal of merchandise or goods.

With the provision of the memory magnet 38, the label 16 can also be deactivated, whereby no summation frequency will be generated, and the label 16 can pass freely through the surveillance zone without being detected by the receiver 20. In the deactivated state, the memory magnet 38 is removed from its degaussed condition, whereby the magnet 38 is fully magnetized. In the fully magnetized state, the memory magnet 38 couples a substantial amount of flux to the nonlinear element 30, thereby saturating the high permeability section 36. When so saturated, the nonlinear element 30 cannot respond to the electromagnetic frequencies 12 and 14, and thus no summation frequency is coupled to the radiating dipole 28. Accordingly, the element 16 can pass freely through the zone of surveillance without being detected by receiver 20.

Figure 5:
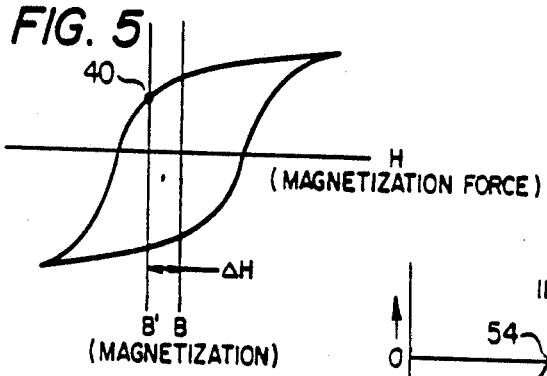
FIG. 5 is a graphical depiction of the biased hysteresis curve of the nonlinear element.

When subjecting the label 16 to a conventional degaussing magnetic field, permanently magnetized members 24 and 26 are not substantially affected, for the reason that the coercive forces of the materials are extremely high. In choosing the particular configuration of the label according to the invention, the magnetic strength of the permanently magnetized members 24 and 26 can be selected in a relationship according to the properties of the memory magnet 38. In accordance with an important feature of the invention, the choice of magnets for use with the label 16 should be selected such that the high permeability section 36 is held constantly at the knee of magnetic saturation by a magnetic field $\Delta H$, as denoted by reference character 40 in FIG. 5. FIG. 5 depicts the conventional magnetization curve of a ferromagnetic material, with the vertical axis representing magnetization (B) and the horizontal axis representing the magnetization force (H).

The curve of FIG. 5 illustrates a conventional presentation of a cyclic B-H curve. Many variations of the shape of this curve, including some of quite extreme shape, are noted in ferromagnetism literature. All such curves relating to any ferromagnetic material and relating to any frequency whatsoever, have a symmetry property such that the folding of the left hand portion of the curve followed by reversal of the direction of its ordinate produces congruence between the portion of the curve left of the zero axis of H and the portion of the curve to the right of the zero axis of H. A mathematical consequence of this antisymmetric feature of the curves is that the tracing of sinusoidal variations of H with respect to time produces harmonics or products which always contain odd numbers of terms. The same proposition is true if a plurality of waves of H are imposed. For example, suppose that the time variation of H is a single wave only, the possible frequency outputs are: A, 3A, 5A . . . If there are two waves of frequency A and B, the possible outputs are: A+2B, A−2B, B+2A, B−2A and all other terms in which the sum of the coefficient is an odd number. The same rule applies whatever number of frequency inputs there may be. These conclusions are a property of the antisymmetry of the curve.

An additional aspect which should be considered in selecting the permanently magnetized members 24 and 26, as well as the memory magnet 38, is the distance by which the permanent magnetized members 24 and 26 are spaced from the nonlinear element 30. The permanently magnetized members 24 and 26 should be spaced from the nonlinear element 30 a distance such that a magnetic field is imposed on the nonlinear element 30 which exceeds the earth's magnetic field by a convenient factor sufficient to avoid a serious interference with the functioning of the label disposed at any orientation with respect to the magnetic field of the earth.

Figure 4:
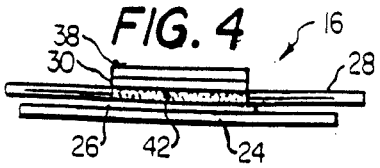
FIG. 4 illustrates a side view of the invention of FIG. 2, shown with the components in final fabricated form.

FIG. 4 shows the composite construction of the label according to the invention. The parts of the label 16 are all sandwiched close together to afford the highest magnetic influence between the parts. Each of the elements of the label are adhered to each other by a suitable high resistance adhesive. The radiating dipole 28 is shown fixed between the permanent magnet 26 and the nonlinear element 30 by a layer of cured adhesive 42.

Conventional labels have, in general, been constructed with slender, highly permeable ferromagnetic materials which are dimensioned such that the ratio of the length squared to the cross-sectional area is favorable for a fast reversal of the magnetic state of the indicating portion of the label. With such a construction, the highest frequencies achievable with present labels is in the range of 2 megahertz. In order to achieve higher frequency responses of such labels, a thinner and more slender label is required, together with a stronger transmitted frequency. According to an important aspect of the present invention, there is provided a nonlinear element 30 responsive to frequencies in the superhigh frequency range. The nonlinear element 30 is of a laminant construction for reducing eddy currents, and thus reducing energy losses at high frequencies. In addition, the nonlinear element 30 is constructed with selected materials to provide an extremely efficient generation of the summation frequency, with electromagnetic frequencies 12 and 14 generated at only moderate energy levels.

Figure 6:
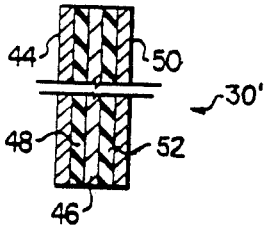
FIG. 6 is a sectional view of the nonlinear element of the invention, illustrating multiple micro-thin layers of nonferromagnetic and insulating materials.

In FIG. 6 there is illustrated a highly enlarged cross-sectional view of the nonlinear element 30', constructed in accordance with the invention. In accordance with the preferred form, the nonlinear element 30' comprises a plurality of very thin material layers 44, 46 and 50 formed of a ferromagnetic material, and layers 48 and 52 formed of an insulating material. Additional layers will normally be provided in an actual device. For protection against the elements of the environment, a thin protective layer (not shown) of electrically nonconducting metallic oxide may be formed over the surface of the nonlinear element 30'. Metal oxides such as lanthanum or rare earth metal oxides can be used to protect the exposed surfaces of the label 16. These oxides may be deposited on the nonlinear element 30' by conventional vapor deposition or evaporation processes.

In keeping with the invention, the thin layers 44, 46 and 50 of ferromagnetic material are maintained sufficiently thin such that the individual layers no longer exhibit ferromagnetic behavior at room temperature. However, when the micro-thin layers of ferromagnetic material 44, 46 and 50 are sandwiched between a very thin layer of insulating material, the composite structure exhibits excellent ferromagnetic characteristics at the superhigh frequency range. The insulating layers 48 and 52 can be formed of a gadolinium or holmium oxide. Other similar metallic oxides are envisioned to operate with equal effectiveness.

A very thin film, in the sense that the term is used in describing the present invention, is a thin layer of an element of composition of matter sufficiently thin that the magnetic properties of the element or composition of matter present in it are found, upon measurement in the thin film, to be observably different from the magnetic properties attributable to the same element or composition of matter in a thick layer, rod, ingot, or other bulk sample.

By constructing the nonlinear element 30' in the foregoing manner, electrical eddy current losses are substantially reduced, thereby providing a more efficient operation in the superhigh frequency ranges. In a further aspect of the invention, subsequent thin layers of a different material may be formed adjacent one another in order to achieve desired permeability and coercive force characteristics. By the use of very thin layers of ferromagnetic material, the flexibility of the label is also enhanced.

It is believed that the excellent ferromagnetic properties of iron arises from the atomic relationship of the iron atoms. Particularly, it is theorized that the ferromagnetic characteristic of iron is attributed to the magnetic ordered state of the iron atoms which have atomic interactions in all six possible spatial directions. It has been established that atoms of iron may be spaced apart very considerably, as for example in a ferrospinel lattice, and nevertheless interact substantially by reason of the exchange integrals of Bethe's Theory. In principle, the thinnest layer of iron which should exhibit a magnetic ordered condition is a layer which may be as thin as three atoms thick. In this case, every iron atom in the middle layer could have possible magnetic interactions in all six directions. The outer two layers of the three atom thick film would have atomic interactions in only five directions. However, it is envisioned that when a monomolecular layer of a suitable oxide is deposited as the middle layer of the three-layer thick iron film, the oxide and oxygen atoms are arranged in a planar manner, whereupon a change in the exchange energy occurs in the atoms of the iron film. As a result, it is believed that a three-layer deposit of iron atoms, succeeded by a planar oxide layer, and yet succeeded by another three-atom thick layer can exhibit useful ferromagnetic characteristics at room temperature. A planar oxide layer may be formed with the use of beryllium or magnesium. Alternatively, trivalent oxide forming elements may be possible, such as oxides of boron, aluminum or lanthanum.

In other things being equal, any ferromagnetic thin film has more utility if it has a large number of lines of magnetic induction per unit cross section of area at saturation. Assuming that all the criteria for producing ferromagnetic order are met, and assuming that all the atoms having any magnetic moment participate in the ordering of the magnetic domain in a thin film composition of matter, the saturation magnetism in lines per square centimeter is the greatest for substances of large average magnetic moment per atom for all the atoms present. In fact, the number of lines can be predicted by forming the product of the number of atoms per cubic centimeter present in the film by the average magnetic moment of these atoms. The noted product multiplied by a coefficient which is universally applicable to all such cases can be depended upon to quantitatively predict the saturation number of magnetic lines in a material or composition of matter that is ferromagnetic, and in which all the magnetically polarizable atoms participate in the domain formation.

The atomic interaction between the separated layers 44, 46 and 50 of ferromagnetic material is believed to occur. This effect is particularly prominent when metallic surfaces are very close to each other. The magnetic field distribution originating from the iron atoms originating on both sides of the thin oxide film interacts, contributing to exchange energy. While the intensity and nature of the magnetic field extending away from the surfaces of layers 44 and 46, and crossing the insulating layer 48 are generally unknown, the magnetic field near the boundaries is heterogeneous and includes a periodicity of the iron atoms in the crystal lattice located along the boundary. According to these principles, and possibly others yet unknown, a succession of layers of nonferromagnetic material, separated by monomolecular layers of electrically insulating material, may exhibit ferromagnetic properties under conditions where one layer alone would not.

The construction of the nonlinear element 30 can be accomplished in the following manner. The thin films constituting the layers 44, 46 and 50 may be formed by chemical deposition from a vaporized compound of iron. With this method, the ferromagnetic element may be evaporated through a vacuum or through a highly attenuated residual atmosphere of hydrogen, in order to form a thin layer which does not exhibit ferromagnetic properties. In addition, the layers 44, 46 and 50 may be formed by sputtering the selected ferromagnetic element by electric discharge in hydrogen, or in an inert gas. These methods of forming the outer layers are compatible with the formation of a suitable insulating oxide 48. It is preferable to form the insulating layer 48 with rare earth oxides, as such oxides can favorably influence the construction of the high frequency electromagnetic multiple layers forming the nonlinear element 30'. When a laminated nonlinear element 30' is constructed, as described above, there is provided a structure which is capable of utilizing the high frequency energy transmitted by the transmitter 10. As noted above, the label 16 produces a summation frequency as a result of the nonlinear characteristics provided by the high permeability section 36 of the nonlinear element 30.

Figure 7:
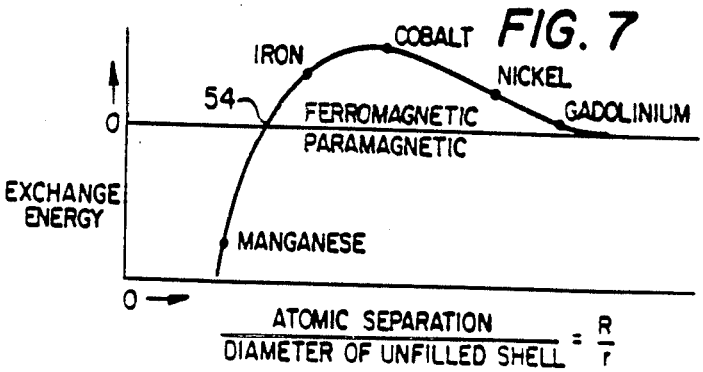
FIG. 7 illustrates Bethe's curve for predicting the existence of ferromagnetism in a material for use in selecting appropriate materials for the present invention.

In accordance with another concept of the invention, the nonlinear element 30 may be constructed in a unitary laminated manner, by intermingling selected materials which individually are not ferromagnetic, but which may be made ferromagnetic when so intermingled. This may be accomplished by the sputtering or evaporation of very thin successive layers of specified materials. The successive thin layers may be as thin as a single atom, if desired. The resulting material is equivalent to materials produced in amorphous form as a result of rapidly cooling a material. It is envisioned that ferromagnetic materials suitable for the label 30' may be those which are identified substantially to the right of point 54 of the horizontal coordinate of the well-known Bethe's curve shown in FIG. 7. By forming an amorphous mixture of the materials so disposed in connection with the Bethe curve, a composition is formed which exhibits a high electrical resistivity, and therefore tends to reduce eddy currents to a minimum. Also, because of the partially disordered state of the composition, a high frequency response may be obtained.

The selection of materials to be intermingled to form an amorphous composition may involve metals which do not exhibit compatible stable alloy forms. In this event, the rate of delivery of atoms of the metals through a vacuum, such as by the well-known evaporation process, may be conducted through a partial vacuum by a sputtering technique which is very slow. Thus, in order to provide a sputtering of atoms on a surface to form a single atomic layer, the rate of deposit of the material should be conducted at a very slow rate, and the surface of the specimen is exposed to the sputtering process for a short period of time. The rate of deposition in the evaporation technique may be made sufficiently slow by lowering the temperature of the metal being evaporated. In a sputtering technique, the rate of deposition is reduced by controlling the electric discharge used to convey the material. As a result, a very small sputtering current conveys a very small amount of metallic deposit per unit of time. When depositing the material through vacuum or partial vacuum, it will normally be advantageous to produce a uniform thin film to provide a population density of atoms or molecules being deposited such that encounters between the atoms or molecules are infrequent during travel from the point of origin to the point of deposition.

In accordance with the invention, the intermingling of materials discussed above in connection with Bethe's curve of FIG. 7 may be accomplished by using two or more sputtering or deposition sources of metallic ingredients, and passing a surface adjacent each of these sources. For example, a rotatable disk may be rotated adjacent the two deposition or sputtering sources, thereby depositing an amorphous composition of the two metallic ingredients on the disk. As another example of the selection of metallic ingredients suitable for use in accordance with the invention, the element halmium may be deposited on the disk simultaneously with an element of the platinum family. The holmium has a ratio of interatomic distance to the diameter of the unfilled electron shell which is quite large, and thus is far to the right of the coordinates presented in Bethe's curve of FIG. 7.

The platinum metal choice, on the other hand, has a corresponding ratio which is small, and thus is to the far left of Bethe's curve. Intermingling of these noted materials in accordance with the above-noted method is believed to provide an amorphous composition which exhibits ferromagnetic properties. The choice of metallic ingredients noted above is provided here for purposes of illustration only, and is thus not meant to restrict or narrow the range of ingredients. Also, the method of deposition of the films noted above is but one of a number of available techniques. It should also be understood that the laminated nonlinear element 30' is not limited to the illustrated number of layers and that many other successive layers may be utilized.

From the foregoing, an improved anti-theft surveillance label is provided. In accordance with the label of the invention, there is provided a permanently magnetized member having a very high coercive force, on the order of several thousand Oersteds. Disposed adjacent the permanently magnetized member is a radiating dipole which is effective to emit electromagnetic radiation in the nature of a summation frequency, as the result of the label passing through a zone of surveillance in which two superhigh frequency signals are transmitted. The label also includes a nonlinear element which includes a high permeability and low permeability section so as to provide an overall nonlinear characteristic. As a result, the two frequencies transmitted in the zone of surveillance act on the nonlinear element, whereupon the low permeability section of the nonlinear element induces a summation or difference frequency, as described above, into the radiating dipole.

The radiating dipole then transmits the summation or difference frequency which is receivable by an alarm and detection device for signalling security personnel of the existence of the label passing through the zone of surveillance. Provided also with the label is a memory magnet which is disposed adjacent the high permeability section of the nonlinear element. The memory magnet has a coercive force on the order of 1,000 Oersted, and is susceptible to an increase or decrease in magnetism when subjected to a degaussing field. The label is made active when the memory magnet is degaussed, and thereby exhibits a reduced magnetic field. As a result, the magnetic field induced in the adjacent high permeability section of the nonlinear element allows the summation or difference frequency to be developed therein and transmitted into the atmosphere by the radiating dipole. When the magnetic strength of the memory magnet has been restored to its full value, the high permeability reluctance section of the nonlinear element becomes saturated, thus disabling the transmission of the summation frequency by the radiating dipole.

In one form of the invention, the nonlinear element is constructed in a laminated manner, having very thin outer layers of a ferromagnetic material, and an insulating inner layer. In another form of the invention, the nonlinear element is constructed by intermingling selected metals to form an amorphous composition. Both forms of the nonlinear element exhibit very low eddy current losses, and thus are responsive to summation or difference frequencies in the superhigh frequency range.

While the preferred embodiments of the method and apparatus have been disclosed with reference to specific constructions and compositions, it is understood that many changes in the detail may be made as a matter of engineering choices without departing from the scope of the invention as defined by the appended claims. Indeed, those skilled in the art may find the principles of the invention applicable to the transformer or electric motor fields. Also, it is not necessary to adopt all the various advantages and features of the present invention into a single composite label in order to realize the individual advantages thereof.

What is claimed is:

1. A method of detecting the unauthorized passage of an article through a zone of surveillance, comprising:

transmitting a pair of frequencies in about the range of 1–30 gigahertz within the zone of surveillance;

attaching a label to the article, said label having a magnetically biased element wherein said magnetic bias results from a magnetic field stronger than a magnetic field associated with the earth;

generating a frequency comprising the summation of the pair of frequencies from said label; and detecting the summation frequency in the zone of surveillance and thereby detecting the unauthorized passage of the article therethrough, the summation frequency being detected to exploit and improve radiation achieved therewith.

2. The method of claim 1 further including transmitting the pair of frequencies generally in a room which comprises the zone of surveillance.

3. The method of claim 2 wherein the room has an exit point and said transmitting step further includes the step of originating the frequencies in the room from a location remote from the exit point of the room.

4. The method of claim 3 further including detecting the summation frequency at a location remote from the exit point of the room.

* * * * *